US006932138B2

(12) United States Patent
Yu et al.

(10) Patent No.: US 6,932,138 B2
(45) Date of Patent: Aug. 23, 2005

(54) ROMAN STYLE SHADE

(75) Inventors: Fu-Lai Yu, Taipei Hsieh (TW); Chin-Tien Huang, Taipei Hsieh (TW); Shun-Chi Yu, Taipei Hsieh (TW)

(73) Assignee: Teh Yor Co., Ltd., Taipei (TW)

( * ) Notice: Subject to any disclaimer, the term of this patent is extended or adjusted under 35 U.S.C. 154(b) by 0 days.

(21) Appl. No.: 10/427,829

(22) Filed: May 1, 2003

(65) Prior Publication Data

US 2004/0216851 A1 Nov. 4, 2004

(51) Int. Cl.[7] ..... A47H 5/00
(52) U.S. Cl. ..... 160/84.01; 160/84.05
(58) Field of Search ..... 160/84.01, 84.03, 160/84.04, 84.05, 84.08, 116, 130, 180, 193

(56) References Cited

U.S. PATENT DOCUMENTS

| | | | | |
|---|---|---|---|---|
| 4,069,857 A | | 1/1978 | Brookshire | 160/84 |
| 4,108,698 A | | 8/1978 | Brookshire | 156/60 |
| 4,921,032 A | | 5/1990 | May | 160/84.1 |
| 5,129,440 A | | 7/1992 | Colson | 160/84.1 |
| 5,375,642 A | | 12/1994 | Gaber et al. | 160/168.1 |
| 5,425,408 A | | 6/1995 | Colson | 160/84.07 |
| 5,566,735 A | | 10/1996 | Jelic | 160/84.4 |
| 5,603,368 A | | 2/1997 | Colson et al. | 160/84.05 |
| 5,680,891 A | * | 10/1997 | Prince | 160/84.05 |
| 5,690,156 A | | 11/1997 | Ruggles | 160/84.04 |
| 5,733,632 A | * | 3/1998 | Marusak | 428/181 |
| 5,787,951 A | * | 8/1998 | Tonomura et al. | 160/84.01 |
| 5,918,655 A | * | 7/1999 | Corey | 160/84.05 |
| 6,006,812 A | * | 12/1999 | Corey | 160/84.05 |
| 2003/0127196 A1 | * | 7/2003 | Corey et al. | 160/84.05 |
| 2003/0188835 A1 | * | 10/2003 | Corey et al. | 160/84.05 |

FOREIGN PATENT DOCUMENTS

| | | | |
|---|---|---|---|
| DE | 28 44 891 A1 | | 4/1980 |
| JP | 07039449 | * | 2/1995 |

* cited by examiner

*Primary Examiner*—Blair M. Johnson
(74) *Attorney, Agent, or Firm*—Olson & Hierl, LTD

(57) ABSTRACT

A window covering having a plurality of panels comprising a head rail and a plurality of panels suspended from the head rail by a securement member and an opening member is provided. Each of the plurality of panels is collapsible and includes a pair of opposed longitudinal regions. A bottom rail may also be provided and suspended from the head rail such that the plurality of panels are located between the head rail and the bottom rail.

62 Claims, 10 Drawing Sheets

Fig. 16A
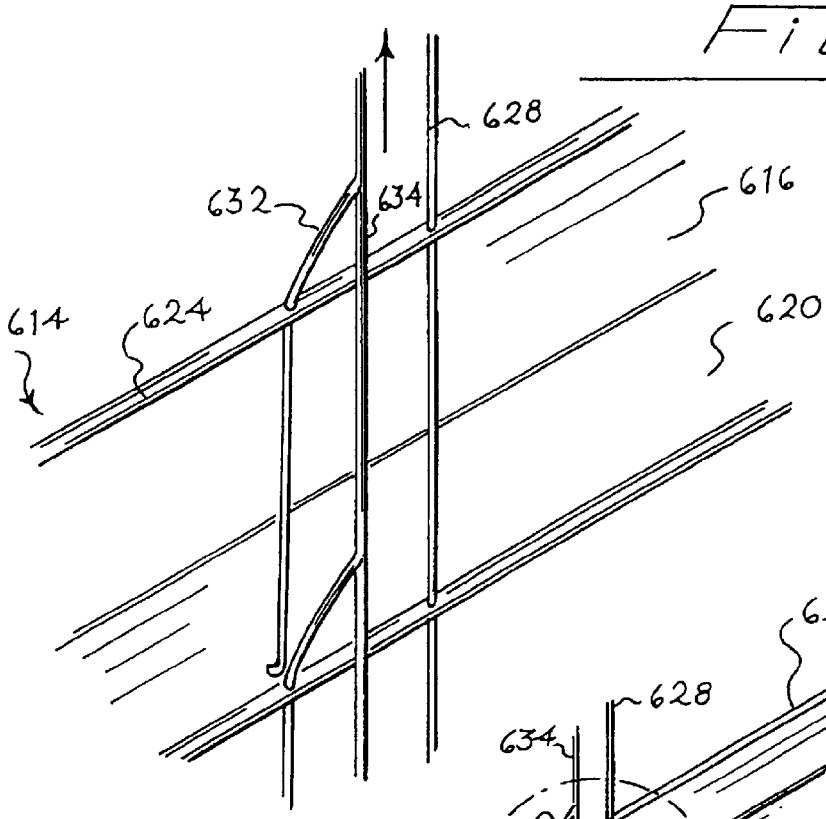
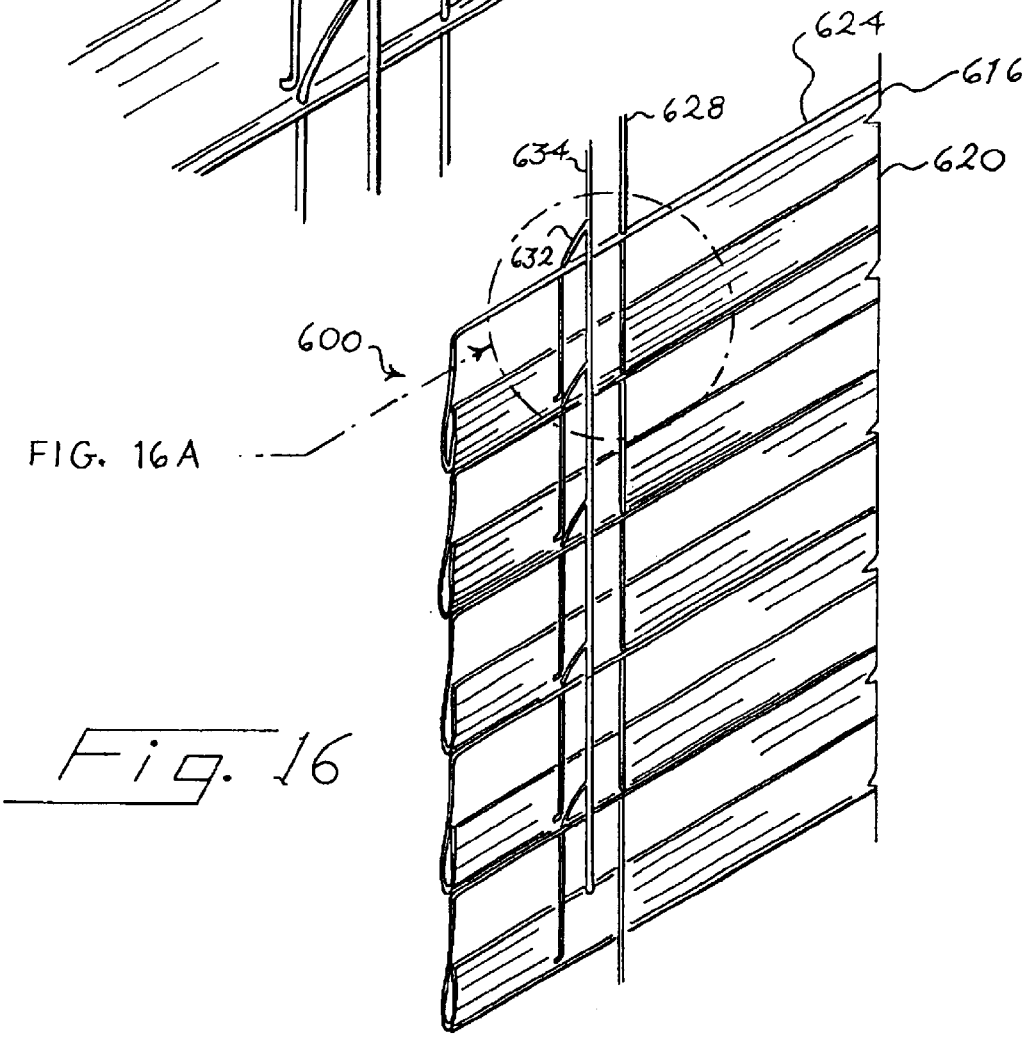
FIG. 16A
Fig. 16

ROMAN STYLE SHADE

TECHNICAL FIELD OF THE INVENTION

This invention relates to an improved window covering. More particularly, this invention relates to an improved window covering having the appearance of a Roman shade but having the ability to provide openings at different intervals.

BACKGROUND OF THE INVENTION

One popular type of window covering is known as a Roman shade. This type of shade consists of a fabric material attached along its top edge to a head rail and gathered at spaced intervals to provide a series of soft folds across the face of the fabric. Consequently, the typical Roman shade has a cascaded or softly pleated appearance. Such Roman shades are constructed so that when they are raised, they gather from the bottom in generally horizontal folds or pleats until the entire shade resides near the top of the window covering. In some versions, the top of the window covering may also be lowered. The shades are operated by pulling on various lines which are used in conjunction with guides attached to the shade.

Most prior art Roman shades are formed either of a flexible material such as a fabric or of a plurality of panels, and are provided with a plurality of horizontal folds at points vertically spaced from one another to form the pleats when the shade is raised. A common method for making a Roman shade is to sew at least two sets of rings or connectors along vertical lines down the back of the fabric material such as is shown in U.S. Pat. No. 1,321,800. A lift cord passes from the head rail through each set of rings and may either be fastened to the bottom edge of the fabric or loop around the bottom edge of the fabric up the front face of the fabric and return to the head rail. Alternatively, each set of connectors is both sewn to the fabric and attached to a cord at spaced apart intervals along the cord. The interval between spacers on each cord may be equal to or less than the distance between the points at which the spacers are attached to the back of the fabric.

One drawback to the typical Roman shade, however, is that there is no way to create openings in the overall face of the window covering if one wishes to permit light into a room, such as found in Venetian blinds by tilting the blind slats, without having to raise the bottom, or lower the top of the entire window covering, which undesirably results in a substantial loss of privacy. Therefore, it is desired to provide the ability to, similar to a Venetian blind, open gaps in the shade to allow light to pass, yet maintain a relatively high degree of privacy by not requiring the shade to be raised or lowered. The present invention also overcomes the shortcoming of the prior art by keeping ladder or other raising and adjustment mechanisms from view when the shade is closed.

SUMMARY OF THE INVENTION

The present invention relates to a window covering having a plurality of panels. The window covering comprises a head rail and a plurality of panels suspended from the head rail by a securement member and an opening member. Each of the plurality of panels is collapsible and includes a pair of opposed longitudinal regions. Each of the plurality of panels may be comprised of fabric material, such as a single continuous fabric material or a plurality of fabric materials. Alternatively, each of the plurality of panels can be comprised of a plurality of longitudinally extending rigid slats, such as typically found with Venetian blinds slats, or may be narrower strips such as bamboo, rattan, wicker or the like. A bottom rail may also be provided and suspended from the head rail, whereby the plurality of panels are located between the head rail and the bottom rail.

The securement member is provided to connect the head rail and the plurality of panels and may be comprised of a cord, fabric strip, a panel of material, or the like. The securement member is restrainedly positioned with each of the plurality of panels about one of the opposed longitudinal regions. Restrained positioning of the panels with the securement member can be accomplished in several manners including, but not limited to, fixedly securing with adhesive, ultrasonic welding, knitting, tying or the like, or restricting the movement of the panel relative to the securement member with a stop or other like restricting member. For example, the movement of the slats can be restricted by stop mechanisms positioned on the securement member. A rigid securement strip to which the securement member is connected can also be utilized.

The opening member, which also connects the head rail and the plurality panels, may be similarly restrainedly positioned with each of the plurality of panels about the longitudinal region opposite where the securement member is connected. For example, where a panel is made of a single piece of material, the pair of opposed longitudinal regions may be the upper and lower edges of the piece of material. As such, the securement member may be restrainedly positioned with the upper edges for each of the plurality of panels, while the opening member is restrainedly positioned with the lower edges. Alternatively, the securement member may be restrainedly positioned with the lower edges for each of the plurality of panels, while the opening member is restrainedly positioned with the upper edges. Reinforcing strips can also be included along either or both of the opposed longitudinal regions.

A vertical adjustment mechanism is operatively connected to the opening member for extending and retracting the opening member. The vertical adjustment mechanism is similar to the mechanism commonly found in Venetian blind systems, such as including a worm gear assembly fitted within the head rail and manipulable by an operatively connected wand, whereby turning the wand causes, in this case, the opening member to be retracted. Alternatively, a cord and cord lock assembly can also be utilized to raise and lower the opening member. As yet another alternative, a power driven or remotely controlled vertical adjustment mechanism can also be utilized.

If the opening member is secured to the lower edge of the plurality of panels, when the vertical adjustment mechanism retracts the opening member, the lower edge of each panel is raised relative to the upper edge and drawn up behind the front of the panel such that openings created in the face of the window covering to permit light to pass. Extending the opening member with the vertical adjustment mechanism causes the lower edge of each panel to lower relative to the upper edge and thereby closed the gaps in the face of the window covering.

BRIEF DESCRIPTION OF THE DRAWINGS

In the drawings,

FIG. 16 is a perspective rear view of the panel of FIG. 15 with the opening member partially retracted;

FIG. 16A is a enlarged partial view of FIG. 16;

DESCRIPTION OF THE PREFERRED EMBODIMENT OF THE INVENTION

Figure 1:
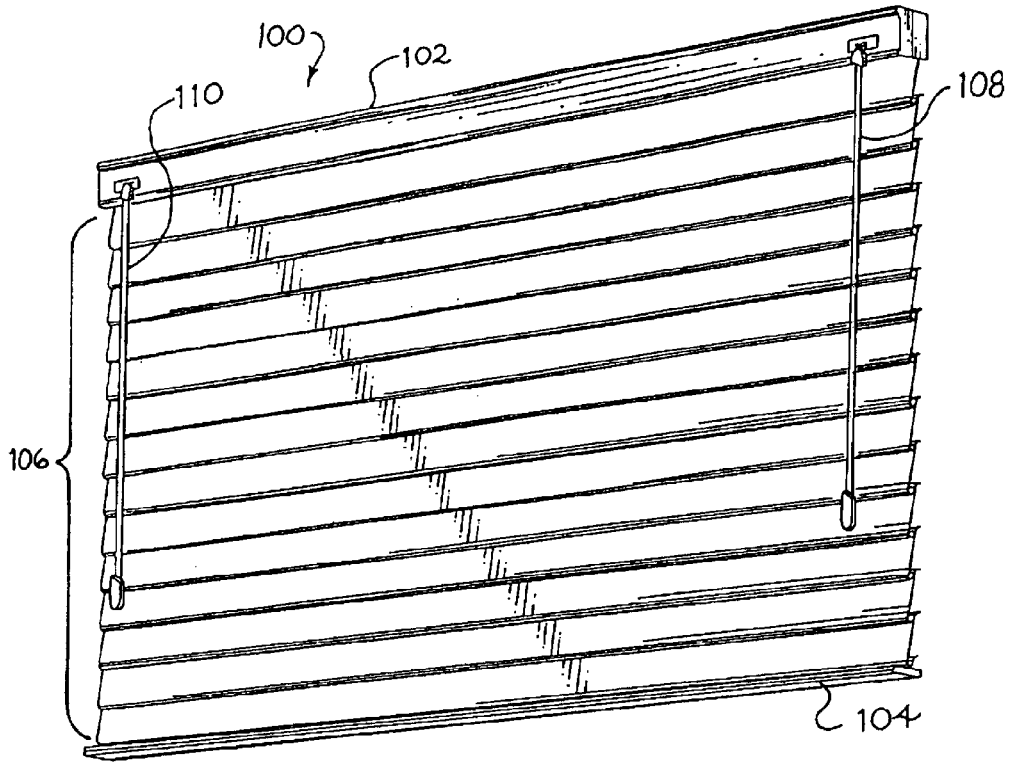
FIG. 1 is a perspective front view of a preferred embodiment of a window covering in a closed position according to the present invention.

The invention disclosed herein is susceptible of embodiment in many different forms. Shown in the drawings and described hereinbelow in detail are preferred embodiments of the invention. It is to be understood, however, that the present disclosure is an exemplification of the principles of the invention and does not limit the invention to the illustrated embodiments.

A preferred embodiment of the present invention is shown in FIG. 1. Window shade 100 is shown in a closed position, and includes a head rail 102, a bottom rail 104, and a plurality of panels 106. Also preferably provided is an opening wand 108 for narrowing the profile of individual panels and thereby creating gaps or openings in the overall face of window shade 100, as well as a raising wand 110 for raising the entire shade 100.

Figure 2:
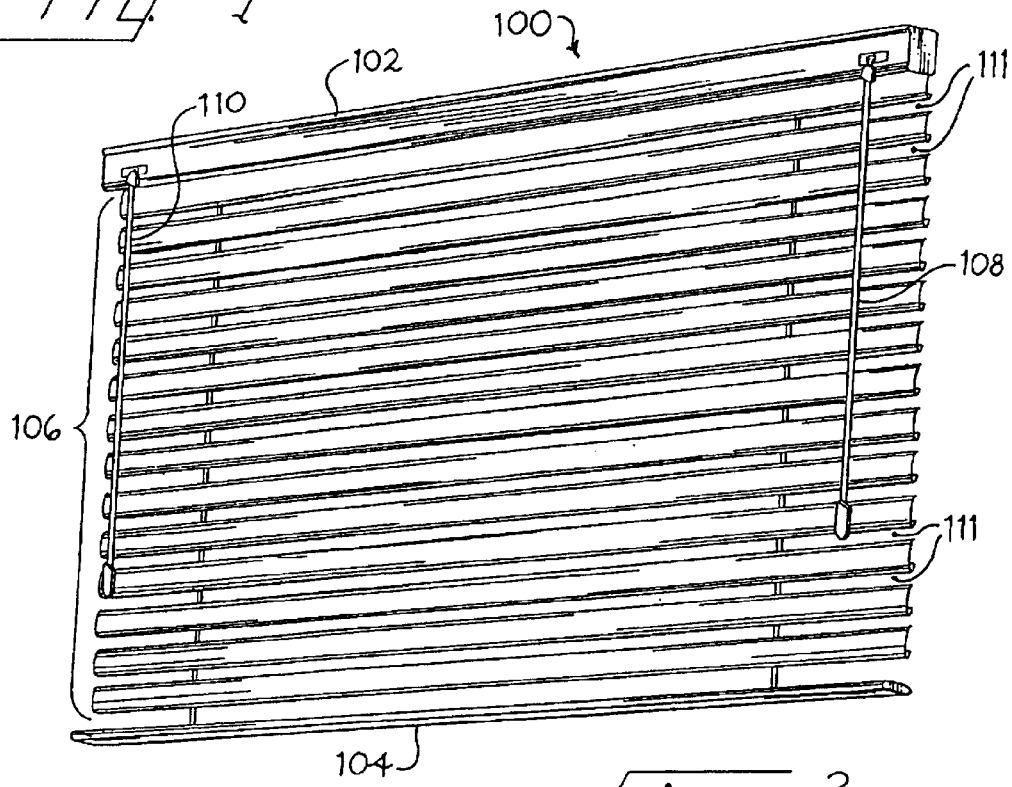
FIG. 2 is a perspective front view of the window covering of FIG. 1 in a partially open position.

In a fully closed state as shown in FIG. 1, the window shade 100 offers an appearance free of connecting cords and provides both privacy and light blocking. If it is desired to allow light into a room without raising the entire shade, and thereby retaining a degree of privacy, a user can rotate the opening wand 108. As the opening wand 108 is rotated, each of the plurality of panels 106 is adjusted to narrow its profile such that gaps 111 in the window shade 100 are opened as shown in FIG. 2. The particular procedure for opening each of the plurality of panels is discussed in further detail below.

Figure 3:
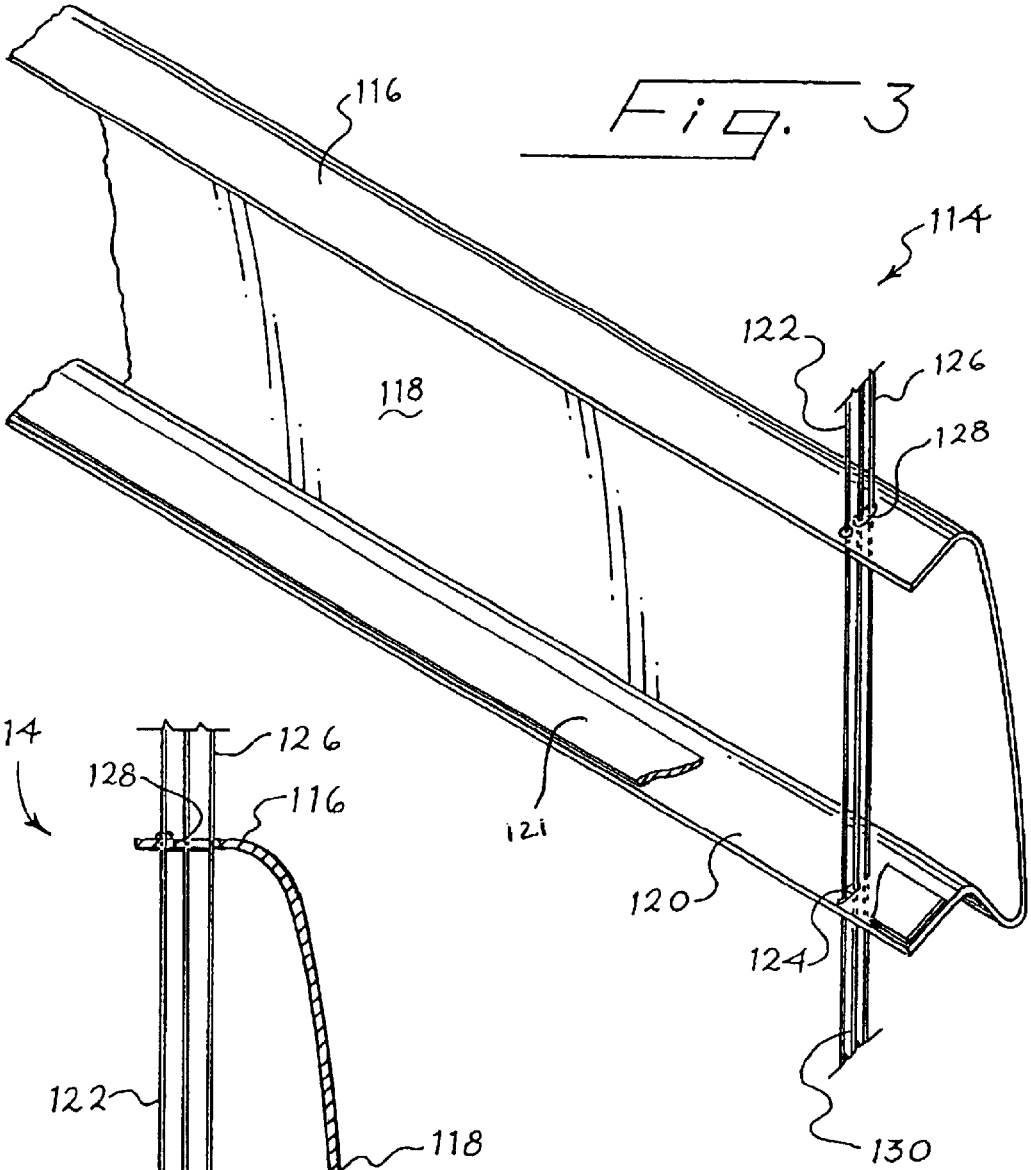
FIG. 3 is a perspective rear view of a preferred embodiment of a panel from the window covering of FIG. 1 with a reinforcing strip shown partially in cross section.
Figure 4:
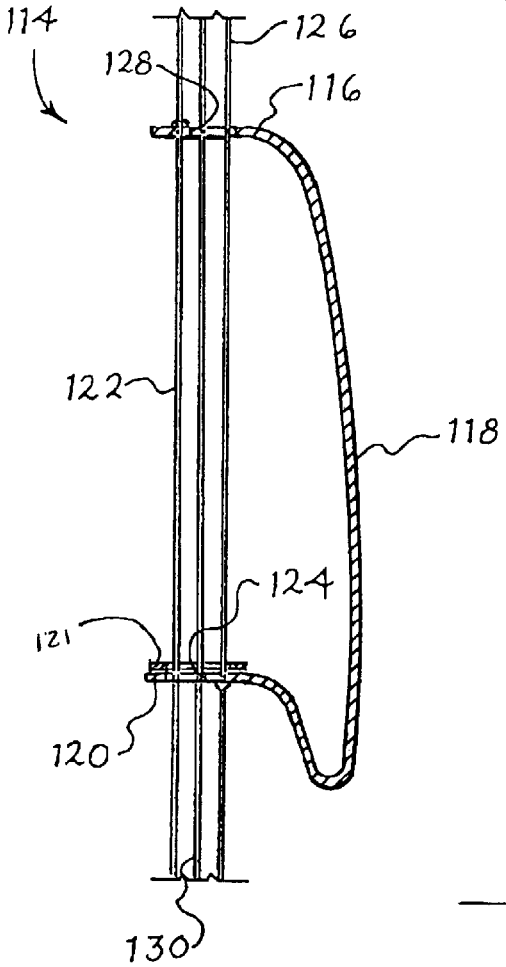
FIG. 4 is a cross sectional view of the panel of FIG. 3.

Referring to FIGS. 3 and 4, the narrowing of the longitudinal profile of one of the plurality of panels from the window covering of FIGS. 1 and 2 is explained. In this embodiment, a panel 114 is formed of a single piece of material having an upper longitudinally extending region 116, a central longitudinally extending region 118, and a lower longitudinally extending region 120. The aggregate of the central region 118 for each of the panels forms the overall face of the window covering. As discussed above, each panel may be comprised of multiple pieces of material. For example, the upper and lower longitudinally extending regions 116 and 120 could be formed of one type of material, whereas the central longitudinally extending region 118 could be a material of a different color, opacity, texture or the like.

Passed through the upper region 116 and the lower region 120 is a securement member, such as cord 122, which is secured to the upper region 116 by way of adhesive, ultrasonic welding, knitting, or the like. Cord 122 is passed through a hole 124 defined by the lower region 120, such that cord 122 is not secured to the lower region 120.

An opening member, such as cord 126 is also provided. Cord 126 is passed through hole 128 defined by the upper region 116, and is secured to lower region 120, also by way of adhesive, ultrasonic welding, knitting, or the like. Each of the plurality of panels is similarly secured to the cords 122 and 126. Alternatively, cords 122 and 126 may be passed through holes, but would include stops fixedly secured thereto so as to limit the cords from passing through the holes. For example, annular members such as washer shaped pieces that are positioned and fixed by pinching the annular member on the opening member and securement member can be utilized.

In this embodiment, as opening member, such as cord 126, is retracted by way of a vertical adjustment mechanism (not shown) in the head rail 102 (FIG. 1), which is operatively connected to the opening wand 108 (FIG. 1), the lower region 120 is urged towards the upper region 116, which remains vertically stationary relative to the head rail. The collapsible panel 114 is thus folded upon itself to present a narrower longitudinal profile. As shown in FIG. 2, openings 111 are created in the plurality of panels to permit light through without requiring the raising or lowering of the entire window covering 100. Referring again to FIGS. 3 and 4, a raising member, such as cord 130 for raising the bottom rail 104 and the plurality of panels 106 is also passed through holes 124 and 128 and secured to bottom rail 104. The raising member, such as cord 130, is operatively connected to raising wand 110 (FIG. 1). Although only one set of cords 122, 126, and 130 is shown, it is preferred that two of sets of cords be provided which are equidistantly spaced from opposite edges of the window covering as can be seen in FIG. 2.

As shown in FIGS. 3 and 4, a reinforcing strip may also be included along either the upper longitudinally extending region, the lower longitudinally extending region, or both. For example, reinforcing strip 121 is shown on the lower longitudinal extending region. This reinforcing strip may be comprised of a thin metal strip, plastic, reinforced material or the like secured to the upper or lower longitudinally extending regions, respectively. Such a reinforcing strip may be included with any of the embodiments disclosed herein.

Figure 5:
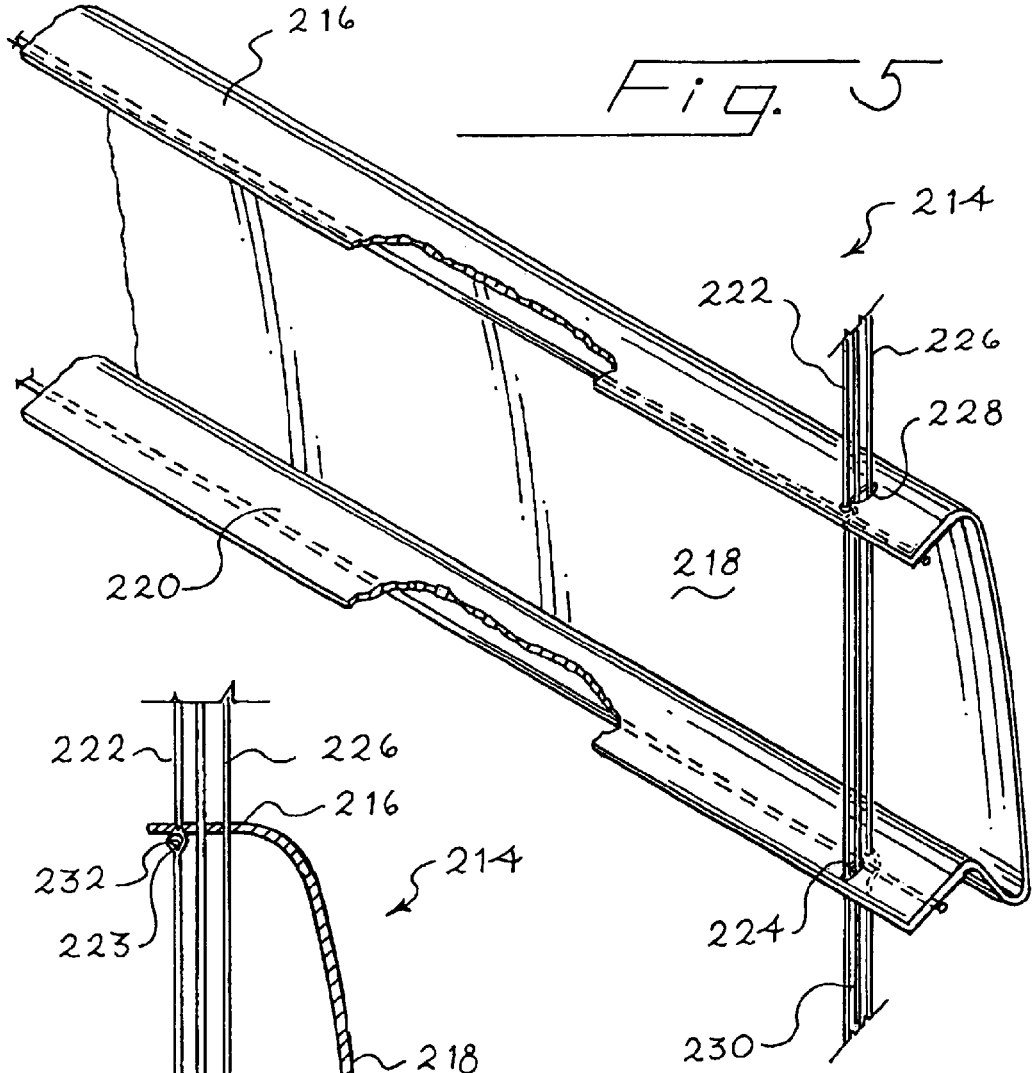
FIG. 5 is an enlarged perspective view of a preferred embodiment of a panel with an alternate method of securing the panel to the securement member.
Figure 6:
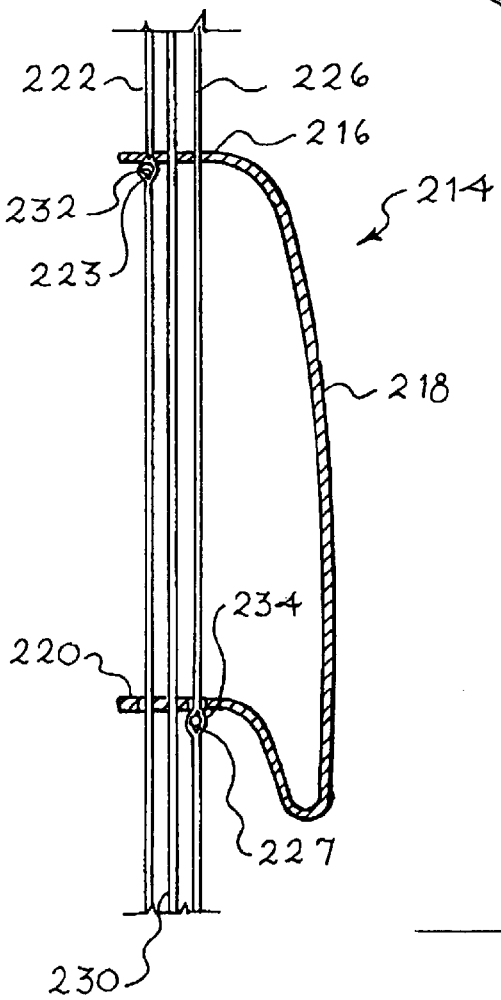
FIG. 6 is an enlarged cross sectional view of the embodiment of FIG. 5.

As discussed above, the securement member and opening member can be restrainedly positioned with the plurality of panels in a variety of ways. Shown in FIGS. 5 and 6 one embodiment utilizes plastic strips. Similar to the embodiment described in FIGS. 3 and 4, a panel 214 is formed of a single piece of material having an upper longitudinally extending region 216, a central longitudinally extending region 218, and a lower longitudinally extending region 220. Passed through hole 228 in the upper region 216 and hole 224 in the lower region 220 is a securement member, such as cord 222. Similarly, opening member 226 is passed through hole 228 in the upper region 216 and hole 224 in the lower region 220. Formed with securement member 222 and opening member 226 are loops 223 and 227, respectively. Securement strips 232 and 234 that are preferably formed of plastic are passed through loops 223 and 227, respectively, and are positioned relative to the panel 214 as depicted such that the downward movement of the panel relative to the securement member 222 and opening member 226 are restricted. If desired, strips 232 and 234 can be fixedly secured to the panel 214, such as by an adhesive.

Figure 7:
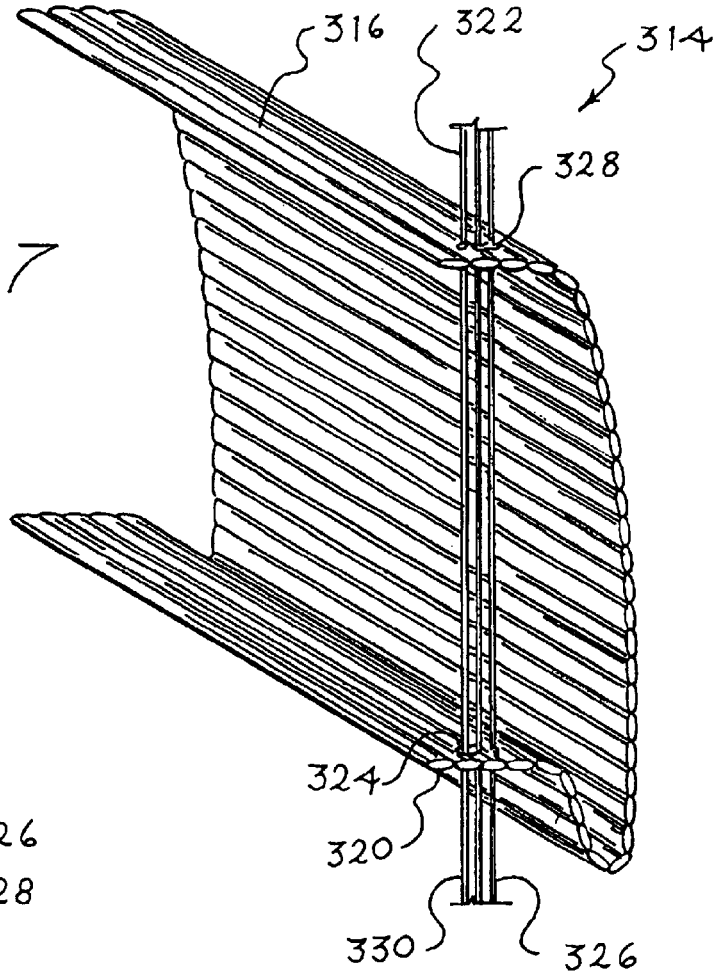
FIG. 7 is a perspective rear view of another alternate embodiment of a panel from a window covering according to the present invention.
Figure 8:
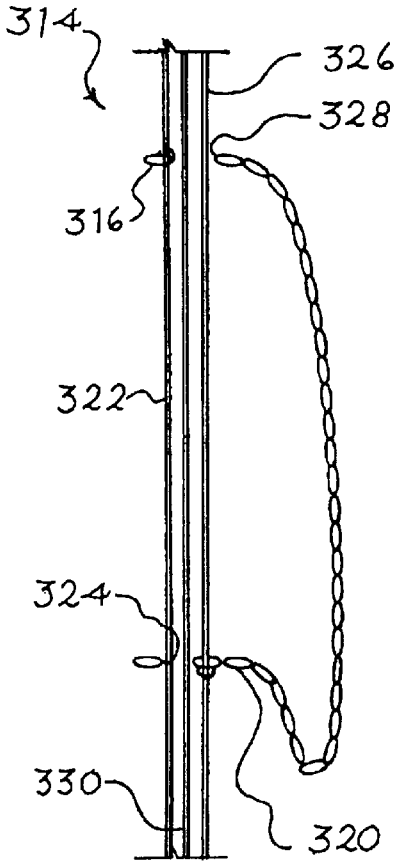
FIG. 8 is a cross section view of the panel of FIG. 7.

An alternative of the present invention is shown in FIGS. 7 and 8. In this embodiment, the plurality of panels is comprised of a plurality of rigid slats. Such slats can be relatively wide slats as typically found in wooden Venetian blinds, or as shown, can be relatively narrow strips of decorative wood, such as wicker, rattan or bamboo. A plurality of relatively narrow strips of wood make up the plurality of panels such as panel 314. An upper region 316 is provided with the plurality of wood strips, and defines a hole 328. The upper region can be comprised of a single strip or may be a number of strips. A lower region 320 can similarly be formed and also defines hole 324. Passed through the upper region 316 and the lower region 320 is a securement member 322, which is secured to the upper region 316 as described above, and is passed through hole 324 in the lower region 320 and is not secured to the lower region 320. An opening member 326 is passed through hole 328 and secured to lower region 320. A raising member 330 for raising the bottom rail and the plurality of panels as described above with the other embodiments is also passed through holes 324 and 328. Similar to the previous embodiments, a cord 326 is retracted such that lower region 320 is pulled towards upper region 316 to create gaps in the overall face of the window shade.

Figure 9:
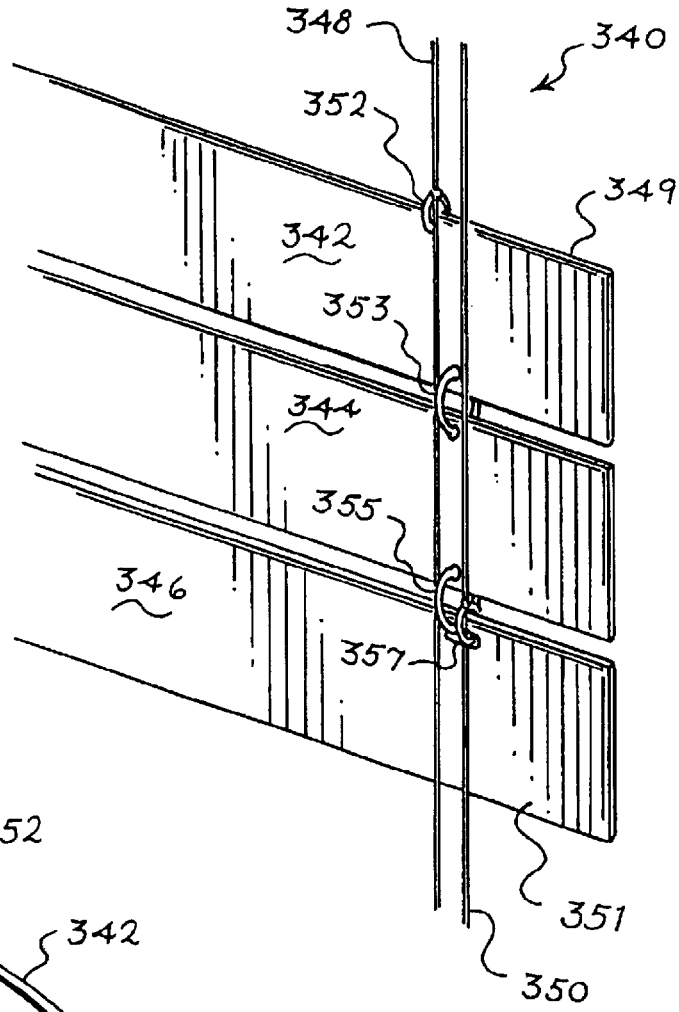
FIG. 9 is a perspective rear view of another alternate embodiment of a panel comprising slats from a window covering according to the present invention.
Figure 10:
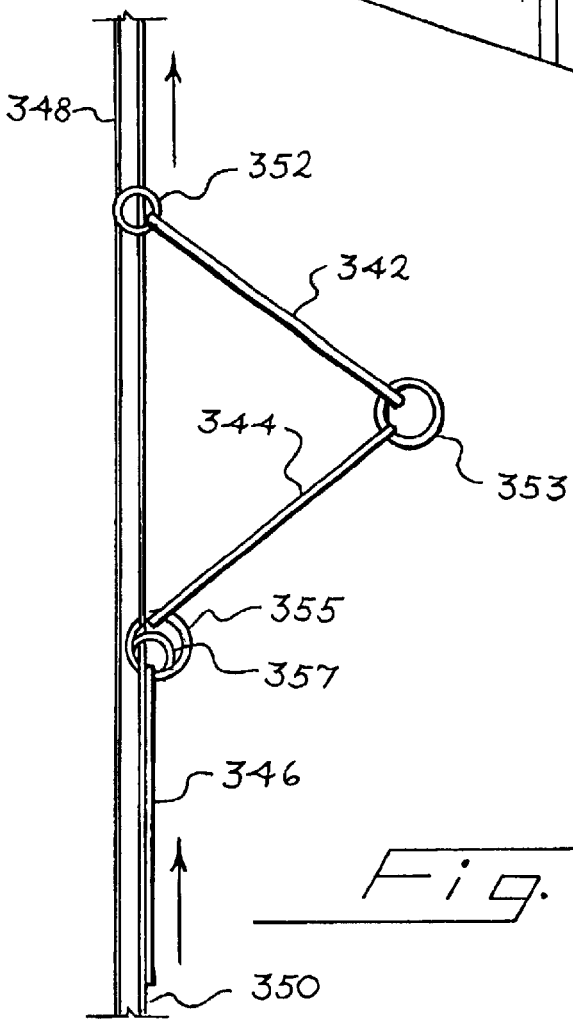
FIG. 10 is a perspective view of the embodiment of FIG. 9, with the slats partially retracted.

Shown in FIG. 9 is an embodiment of the present invention wherein each of the plurality of panels is comprised of slats, such as those typically found in wooden Venetian blinds. In this example, the panel 340 is comprised of three slats, 342, 344, and 346, but more slats can be used. Securement member 348 is secured to slat 342 about an upper edge 349 by ring 352. Opening member 350 is secured to slat 346 also about a lower edge 351. In this particular embodiment, rings 353 and 355 connect slats 342, 344, and 346. An additional ring 357 is secured to lowermost slat 346, to which opening member 350 is secured. Referring to FIG. 10, as the opening member 350 is retracted, lowermost slat 346 is pulled upwards, which causes slats 342 and 344 to deflect and fold onto one another.

Figure 11:
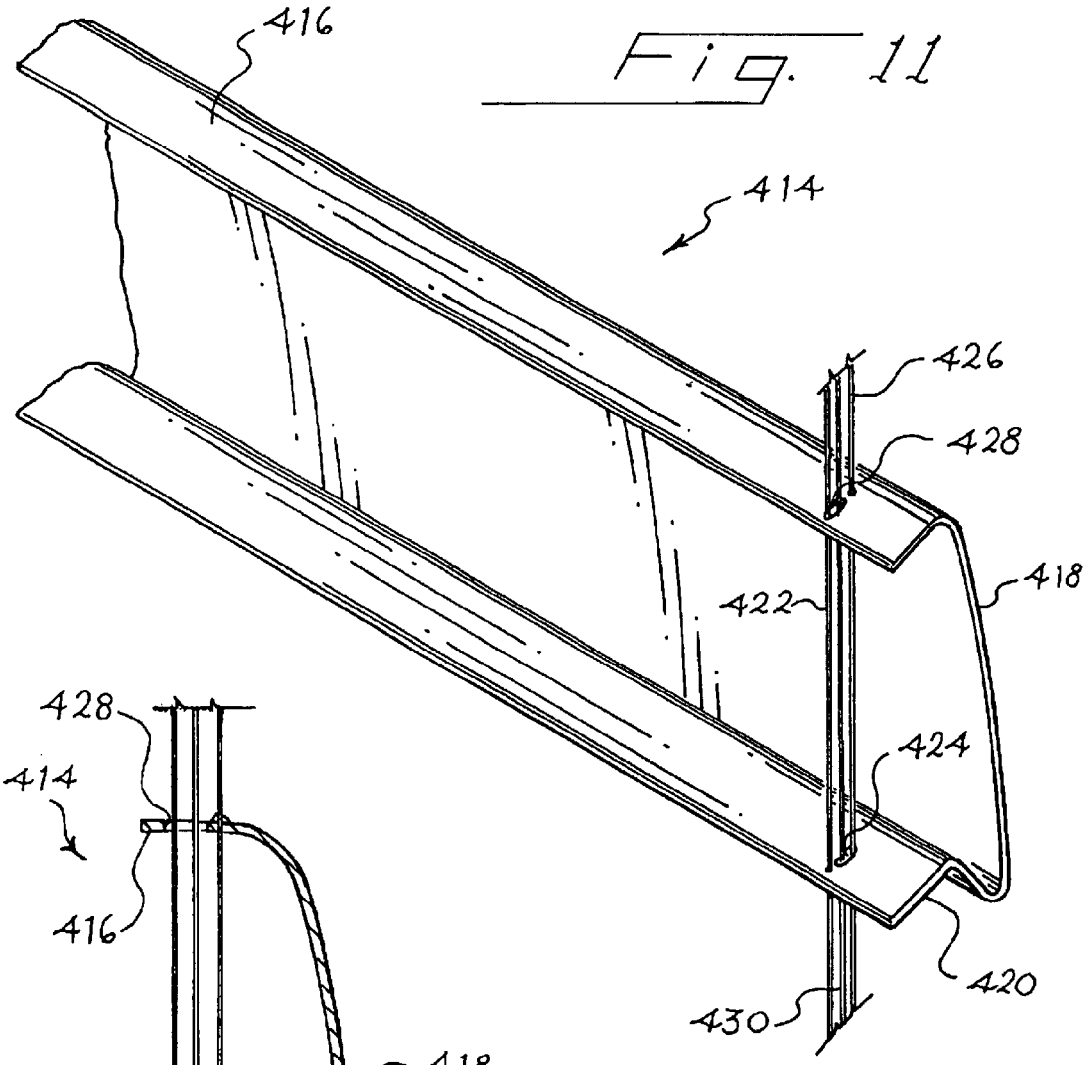
FIG. 11 is a perspective rear view of yet another alternate embodiment of a panel from a window covering according to the present invention.
Figure 12:
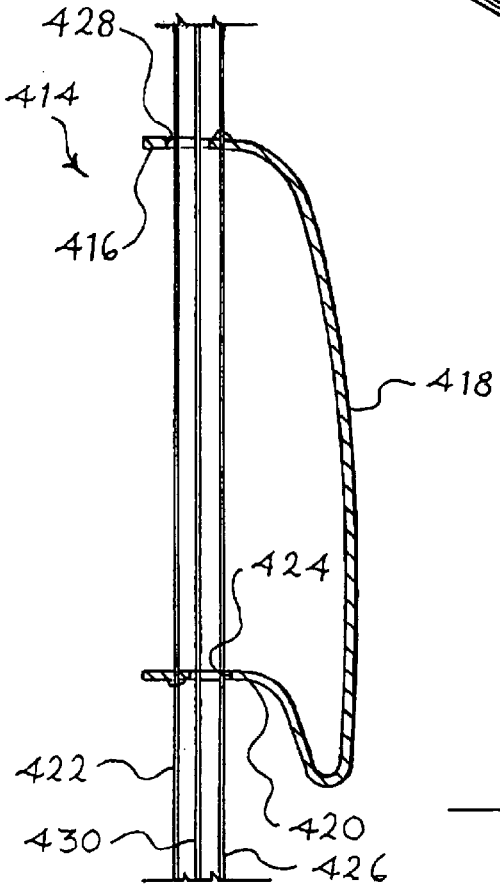
FIG. 12 is a cross section view of the panel of FIG. 11.

In each of the embodiments shown thus far, gaps in the face of the window shade, i.e., the open position, have been created by pulling the lower region of a panel towards the upper region. It is contemplated, however, that gaps in the face of the window shade can also be created by lowering the upper region towards the lower region, which is held in place. An example of such an embodiment is shown in FIGS. 11 and 12.

In this embodiment, a panel 414 is formed of a single piece of material having an upper longitudinally extending region 416, a central longitudinally extending region 418, and a lower longitudinally extending region 420. Passed through the upper region 416 and the lower region 420 is a securement member 422, which is fixedly secured to the lower region 420. Securement member 422 is passed through a hole 428 defined by the upper region 416, such that it is not secured to the upper region 416. An opening member is also provided, and is secured to upper region 416. In this embodiment, as opening member 426 is extended by way of a vertical adjustment mechanism in the head rail, the upper region 416 is lowered towards the lower region 420, which is held substantially stationary relative to the head rail by the securement member 422. As such, the collapsible panel 414 folds upon itself to present a narrower longitudinal profile. Similar to the previous embodiments, a raising member, such as cord 430 for raising the bottom rail and the plurality of panels is also passed through holes 424 and 428. A similar arrangement whereby the upper region is lowered to the lower region can be utilized in any of the configurations previously described.

Figure 13:
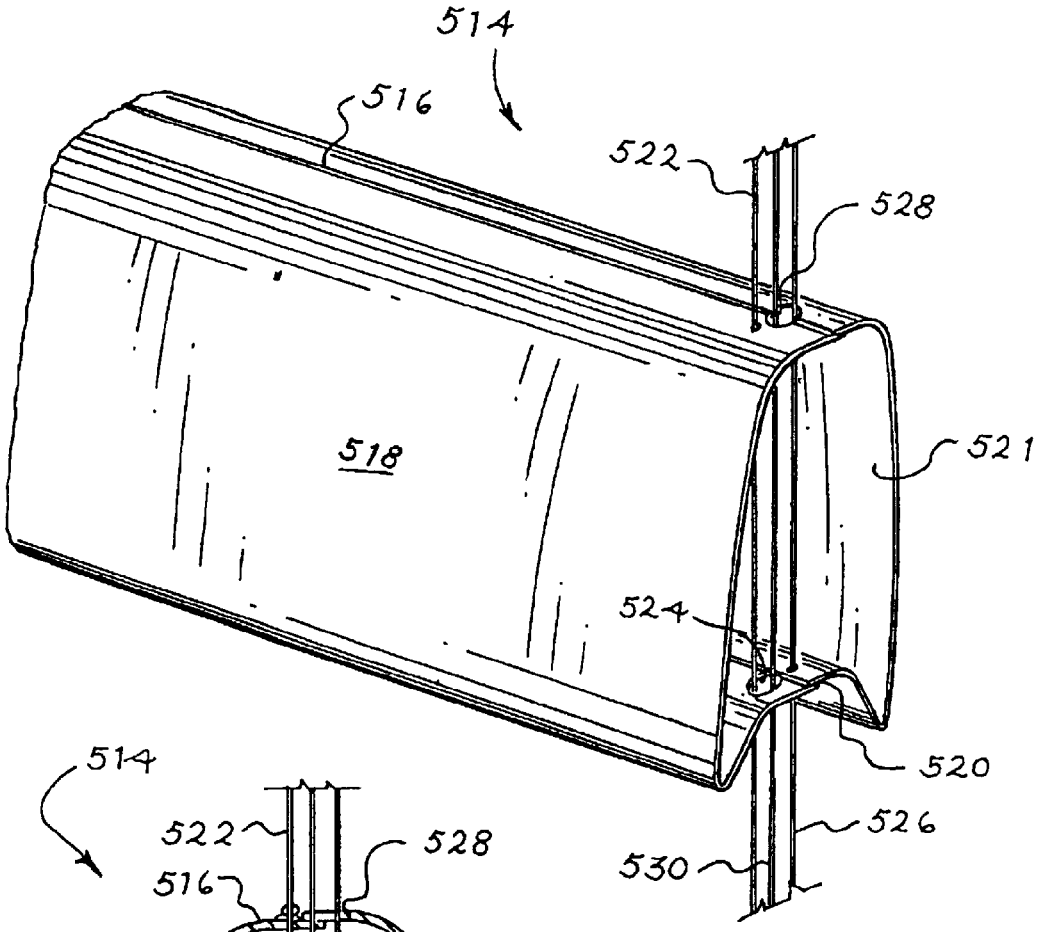
FIG. 13 is a perspective rear view of another alternate embodiment of a panel from a window covering according to the present invention.
Figure 14:
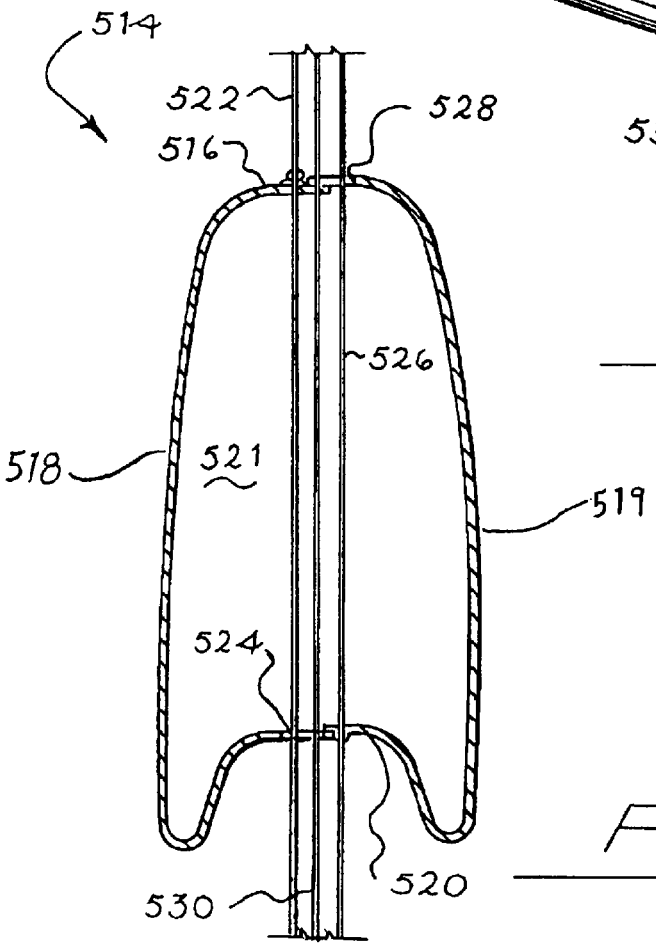
FIG. 14 is a cross section rear view of the panel of FIG. 13.

In yet another alternative embodiment, an additional facing can be included in order to provide both a face and back to the window covering that is free of visible cords or connectors when in the closed position. Referring to FIG. 13 and 14, panel 514 is an example of a panel from the plurality of panels that makes up a double-faced window covering.

Panel 514 is formed of a piece of material having an upper longitudinally extending region 516, a central longitudinally extending face region 518, a central longitudinally extending back region 519 and a lower longitudinally extending region 520. The piece of material may be a single piece of material which is secured to itself to form a continuous piece of material. Alternatively, multiple strips of material can be secured together. The multiple strips of material may be the same material, or may be materials having different characteristics, i.e., color, opacity, etc. As shown, panel 514 defines a longitudinally extending cell 521.

Passed through the upper region 516 and the lower region 520 is a securement member 522, which is secured to the upper region 516. Securement member 522 is also passed through a hole 524 defined by the lower region 520, such that it is not secured to the lower region 520. An opening member 526 is also provided and is passed through hole 528 defined by the upper region 516, and is also secured to lower region 520. Each of the plurality of panels is similarly formed and secured to the securement member 522 and opening member 526. Preferably, members 522, 526 and 530 are positioned such that equal amounts of material are suspended on either side of the cords. As opening member 526 is retracted the lower region 520 is urged towards the upper region 516, which remains vertically stationary relative to the head rail. As such, cell 521 is collapsed upon itself and presents a narrower longitudinal profile.

Figures 15, 15A:
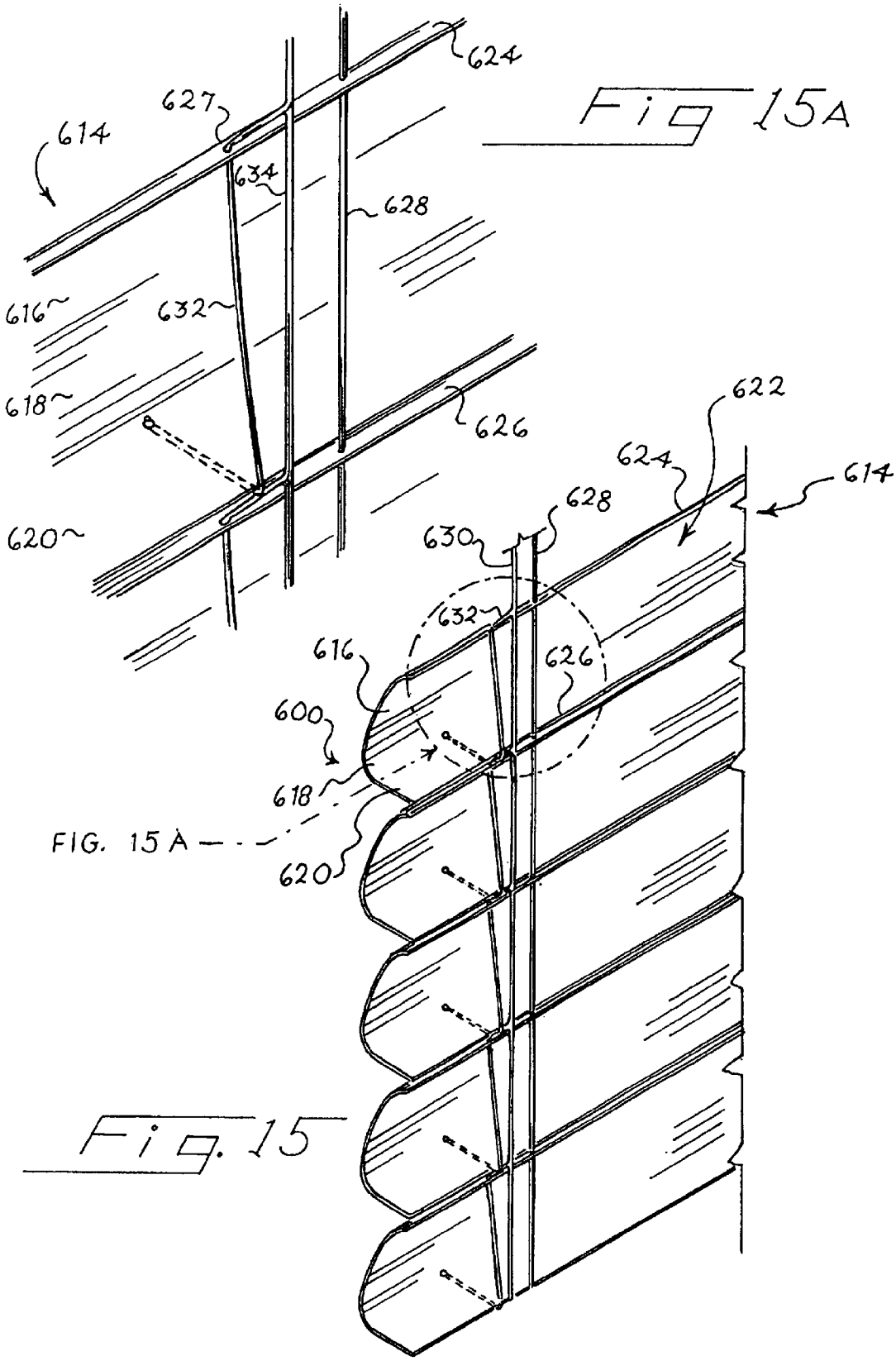
FIG. 15 is a perspective rear view of another alternate embodiment of a panel from a window covering according to the present invention.
FIG. 15A is a enlarged partial view of FIG. 15.
Figure 17A:
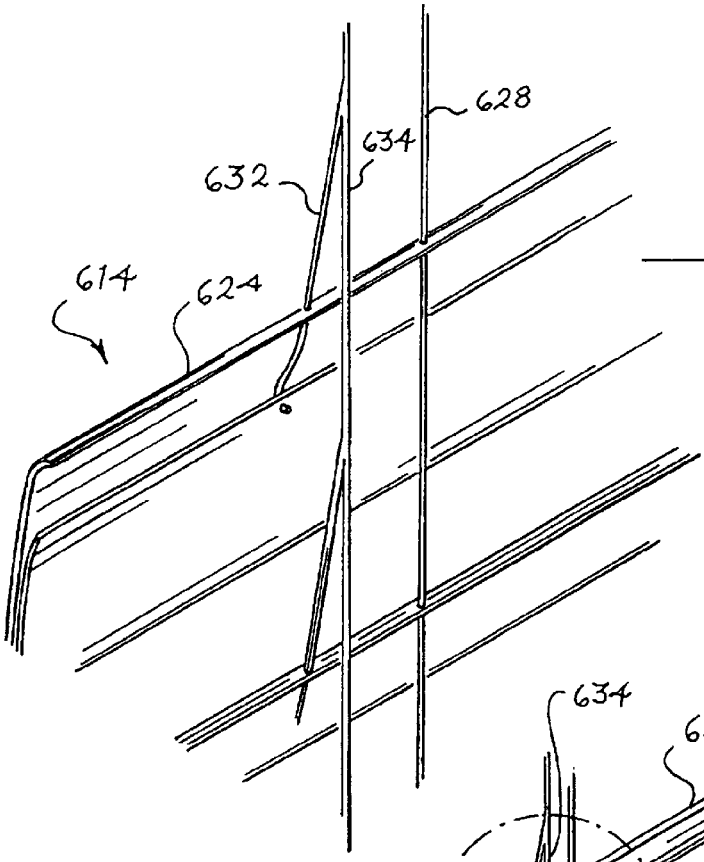
FIG. 17A is a enlarged partial view of FIG. 17.
Figure 17:
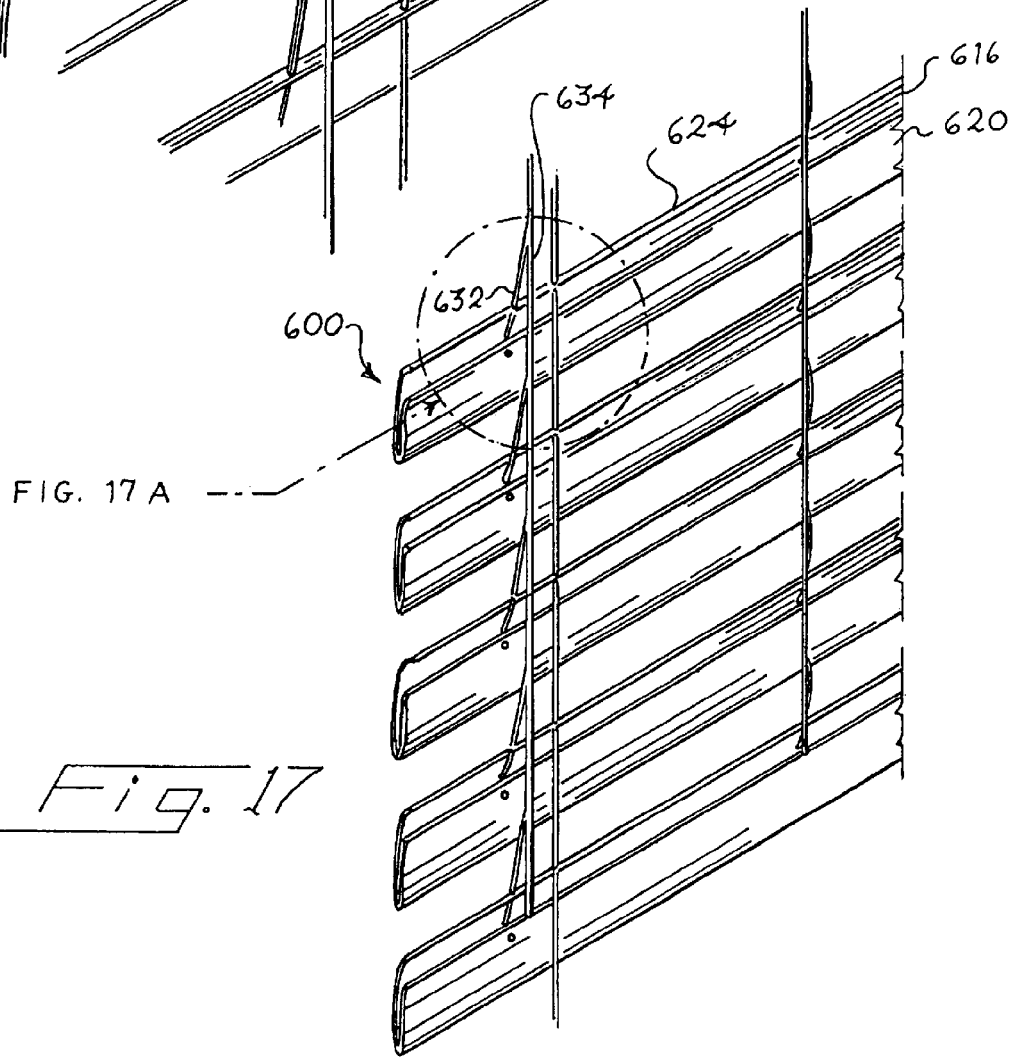
FIG. 17 is a perspective rear view of the panel of FIG. 15 fully retracted.

Another embodiment is shown in FIGS. 15 and 15A. In this embodiment, window covering 600 is made of a plurality of panels, such as panel 614. Each panel is made of a plurality of slats, such as 616, 618, and 620. The panel also defines a face (not shown), a rear 622, an uppermost region 624, and a lowermost region 626. As in other embodiments described above, a securement member 628 is restrainedly positioned with the uppermost region 624. An opening member 630 is also provided. In this example, the opening member 630 is comprised of a roll-up member 632 and lifting member 634. The uppermost region 624 defines a hole 627, through which the roll-up member 632 is passed. One end of the roll-up member 632 is connected to the lifting member 634. Preferably, secured to the lifting member 634 are a plurality of roll-up members, one for each panel. The roll-up member is passed under the lowermost region 626 of panel 614 and is secured to the face of the panel 614 about a region adjacent to the lowermost region 626. For example, the roll-up member 632 is secured to the face about a top region of slat 620. As the lifting member 634 is raised, the roll-up member 632 is pulled through the hole 627 such that slat 620 is rolled up as shown in FIGS. 16, 16A 17 and 17A. As such, gaps are created in the window covering.

Although shown with a panel comprising a plurality of slats, the roll-up member can also be used with a panel comprised of a fabric material. In order to lessen the visual effect of the roll-up member, it may be comprised of a material similar in color to the panel. As shown, the roll-up member may also serve to limit the extent to which the panel is extended such that a billowed appearance is achieved.

The foregoing descriptions are to be taken as illustrative, but not limiting. Still other variants within the spirit and scope of the present invention will readily present themselves to those skilled in the art.

What is claimed is:

1. A window covering movable between a closed position and an open position, and comprising:

a head rail;

a plurality of collapsible panels suspended from the head rail, each of the plurality of panels having a pair of opposed longitudinal regions and also having a face, the pair of opposed longitudinal regions including an upper region and a lower region;

a securement cord connecting the head rail and the plurality of panels;

an opening cord connecting the head rail and the plurality of panels;

the securement cord including a plurality of spaced loops and being restrainedly positioned with each of the plurality of panels about one of the opposed longitudinal regions by an anchor member guided through one of the spaced loops, and the opening cord being restrainedly positioned with each of the plurality of panels about the longitudinal region opposite the securement cord; and a vertical adjustment mechanism operatively connected to the opening cord for independently adjusting the position of the opening cord relative to the securement cord such that a distance between the lower longitudinal region and the upper longitudinal region of each of the plurality of panels is decreased, and wherein the lower longitudinal region is positioned behind the face of the panel to move the window covering between the closed position and the open position.

2. The window covering of claim 1, wherein the securement cord is restrainedly positioned with each of the plurality of panels about the upper region and the opening cord is restrainedly positioned about the lower region.

3. The window covering of claim 2, wherein the securement cord is fixedly secured to each of the plurality of panels about the upper region.

4. The window covering of claim 2, wherein the securement cord is restrainedly positioned by at least one stop with each of the plurality of panels.

5. The window covering of claim 1, wherein the securement cord is restrainedly positioned with each of the plurality of panels about the lower region and the opening cord is restrainedly positioned about the upper region.

6. The window covering of claim 5, wherein the securement cord is fixedly secured to each of the plurality of panels about the lower region.

7. The window covering of claim 5, wherein the securement cord is restrainedly positioned by at least one stop with each of the plurality of panels.

8. The window covering of claim 1, wherein each of the plurality of panels is comprised of fabric.

9. The window covering of claim 8, wherein the fabric is a single longitudinally extending strip.

10. The window covering of claim 8, wherein the fabric is a plurality of pieces of fabric.

11. The window covering of claim 8, wherein the fabric defines a longitudinally extending cell.

12. The window covering of claim 1, wherein each of the plurality of panels is comprised of a plurality of longitudinally extending rigid slats.

13. The window covering of claim 1, further including a bottom rail suspended from the head rail by a retractable raising member.

14. The window covering of claim 1, further including reinforcing strips secured about the pair of opposed longitudinal regions.

15. The window covering of claim 1, further including at least one reinforcing strip secured about at least one of the pair of opposed longitudinal regions.

16. The window covering of claim 1, wherein the opening cord is comprised of a lifting member and plurality of roll-up members.

17. A window covering, comprising:

a head rail;

a plurality of collapsible panels suspended from the head rail;

at least one of the plurality of panels having a pair of opposed longitudinally extending regions, the pair of opposed regions operatively connected to the head rail by a securement cord including a plurality of spaced loops and an opening cord, the pair of opposed longitudinal regions including an upper region and a lower region, wherein an anchor member is guided through one of the spaced loops to restrainedly position the securement cord with the panel; and a vertical adjustment mechanism operatively connected to the opening cord for independently adjusting the position of the opening member relative to the securement cord such that a distance between the lower longitudinal region and the upper longitudinal region of each of the at least one of the plurality of panels is decreased, and wherein the lower longitudinal region is positioned behind a face of the panel.

18. The window covering of claim 17, wherein the securement cord is restrainedly positioned with the at least one panel about the upper region and the opening cord is restrainedly positioned about the lower region.

19. The window covering of claim 18, wherein the securement cord is fixedly secured to the at least one panel about the upper region.

20. The window covering of claim 18, wherein the securement cord is restrainedly positioned by at least one stop with the at least one panel.

21. The window covering of claim 17, wherein the securement cord is restrainedly positioned with the at least one panel about the lower region and the opening cord is restrainedly positioned about the upper region.

22. The window covering of claim 19, wherein the securement cord is fixedly secured to the at least one panel about the lower region.

23. The window covering of claim 21, wherein the securement cord is restrainedly positioned by at least one stop with the at least one panel.

24. The window covering of claim 17, wherein each of the plurality of panels is comprised of fabric.

25. The window covering of claim 24, wherein the fabric is a single longitudinally extending strip.

26. The window covering of claim 24, wherein the fabric is a plurality of pieces of fabric.

27. The window covering of claim 24, wherein the fabric material defines a longitudinally extending cell.

28. The window covering of claim 17, wherein the at least one panel is comprised of a plurality of longitudinally extending rigid slats.

29. The window covering of claim 17, wherein the opening cord is comprised of a lifting member and plurality of roll-up members.

30. The window covering of claim 17, further including a bottom rail suspended from the head rail by a retractable raising member.

31. The window covering of claim 17, further including reinforcing strips secured about the pair of opposed longitudinal regions.

32. The window covering of claim 17, further including at least one reinforcing strip secured about at least one of the pair of opposed longitudinal regions.

33. A window covering movable between a closed position and an open position, and comprising:

a head rail;

a plurality of collapsible panels suspended from the head rail, each of the plurality of collapsible panels having a pair of opposed longitudinal regions and a face, each of the plurality of panels further comprising a plurality of rigid slats, and the pair of opposed longitudinal regions including an upper region and a lower region;

a securement member connecting the head rail and the plurality of panels;

a opening member connecting the head rail and the plurality of panels;

the securement member being restrainedly positioned with each of the plurality of panels about one of the opposed longitudinal regions and the opening member being restrainedly positioned with each of the plurality of panels about the longitudinal region opposite the securement member; and a vertical adjustment mechanism operatively connected to the opening member for independently adjusting the position of the opening member relative to the securement cord such that a distance between the lower longitudinal region and the upper longitudinal region of each of the plurality of panels is decreased, and wherein the lower longitudinal region is positioned behind the face of the panel to move the window covering between the closed position and the open position.

34. The window covering of claim 33, wherein the securement member is restrainedly positioned with at least one panel about the upper region and the opening member is restrainedly positioned about the lower region.

35. The window covering of claim 34, wherein the securement member is fixedly secured to the at least one panel about the upper region.

36. The window covering of claim 34, wherein the securement member is restrainedly positioned by at least one stop with the at least one panel.

37. The window covering of claim 33, wherein the securement member is restrainedly positioned with the at least one panel about the lower region and the opening member is restrainedly positioned about the upper region.

38. The window covering of claim 37, wherein the securement member is fixedly secured to the at least one panel about the lower region.

39. The window covering of claim 37, wherein the securement member is restrainedly positioned by at least one stop with the at least one panel.

40. The window covering of claim 33, further including a bottom rail suspended from the head rail by a retractable raising member.

41. The window covering of claim 33, further including reinforcing strips secured about the pair of opposed longitudinal regions.

42. The window covering of claim 33, further including at least one reinforcing strip secured about at least one of the pair of opposed longitudinal regions.

43. The window covering of claim 33, wherein the opening member is comprised of a lifting member and plurality of roll-up members.

44. A window covering movable between a closed position and an open position, and comprising:

a head rail;

a plurality of collapsible panels suspended from the head rail, each of the plurality of collapsible panels having a pair of opposed longitudinal regions and a face, each of the plurality of panels defining an longitudinally extending cell when the window covering is in the closed position and further comprising at least one piece of fabric, and the pair of opposed longitudinal regions including an upper region and a lower region;

a securement member connecting the head rail and the plurality of panels;

a opening member connecting the head rail and the plurality of panels;

the securement member being restrainedly positioned with each of the plurality of panels about one of the opposed longitudinal regions and the opening member being restrainedly positioned with each of the plurality of panels about the longitudinal region opposite the securement member; and a vertical adjustment mechanism operatively connected to the opening member for independently adjusting the position of the opening member relative to the securement cord such that a distance between the longitudinal region and the upper longitudinal region of each of the plurality of panels is decreased, and wherein the lower longitudinal region is positioned behind the face of the panel to move the window covering between the closed position and the open position.

45. The window covering of claim 44, wherein the securement member is restrainedly positioned with at least one panel about the upper region and the opening member is restrainedly positioned about the lower region.

46. The window covering of claim 45, wherein the securement member is fixedly secured to the at least one panel about the upper region.

47. The window covering of claim 45, wherein the securement member is restrainedly positioned by at least one stop with the at least one panel.

48. The window covering of claim 44, wherein the securement member is restrainedly positioned with the at least one panel about the lower region and the opening member is restrainedly positioned about the upper region.

49. The window covering of claim 48, wherein the securement member is fixedly secured to the at least one panel about the lower region.

50. The window covering of claim 48, wherein the securement member is restrainedly positioned by at least one stop with the at least one panel.

51. The window covering of claim 44, Wherein the fabric is a single longitudinally extending piece of fabric.

52. The window covering of claim 44, wherein the fabric is a plurality of pieces of fabric.

53. The window covering of claim 44, wherein the securement member is a cord.

54. The window covering of claim 44, further including a bottom rail suspended from the head rail by a retractable raising member.

55. The window covering of claim 44, further including reinforcing strips secured about the pair of opposed longitudinal regions.

56. The window covering of claim 44, further including at least one reinforcing strip secured about at least one of the pair of opposed longitudinal regions.

57. A window covering movable between a closed position and an open position, and comprising:

a head rail;

a plurality of collapsible panels having a face and a back and suspended from the head rail, each of the plurality of collapsible panels having an uppermost longitudinal region and a lowermost longitudinal region, wherein the uppermost longitudinal region defines a hole;

a securement member connecting the head rail and the plurality of panels, the securement member being restrainedly positioned with each of the plurality of panels about the uppermost longitudinal region;

a opening member connecting the head rail and the plurality of panels, the opening member further including an elongated roll-up member extending through the hole defined by the uppermost longitudinal region, spanning the back of the panel, and secured to a region of the face of the panel adjacent the lowermost longitudinal region; and a vertical adjustment mechanism operatively connected to the opening member for extending and retracting the opening member to move the window covering between the closed position and the open position.

58. The window covering of 57, wherein each of the plurality of panels is comprised of a plurality of longitudinally extending slats.

59. The window covering of claim 33, wherein the securement cord is restrainedly positioned with at least one of the plurality of panels by a stop.

60. The window covering of claim 59, wherein the stop is an anchor member, and the securement cord includes a plurality of spaced loops, and the anchor member is guided through one of the spaced loops to restrainedly position the securement cord with the panel.

61. The window covering of claim 44, wherein the securement cord is restrainedly positioned with at least one of the plurality of panels by a stop.

62. The window covering of claim 61, wherein the stop is an anchor member, and the securement cord includes a plurality of spaced loops, and the anchor member is guided through one of the spaced loops to restrainedly position the securement cord with the panel.

* * * * *